US009173451B2

(12) United States Patent
Shim

(10) Patent No.: US 9,173,451 B2
(45) Date of Patent: Nov. 3, 2015

(54) HEEL COUNTER SUPPORT FOR SHOE

(76) Inventor: Sang-Ok Shim, Busan (KR)

( * ) Notice: Subject to any disclaimer, the term of this patent is extended or adjusted under 35 U.S.C. 154(b) by 67 days.

(21) Appl. No.: 13/343,934

(22) Filed: Jan. 5, 2012

(65) Prior Publication Data

US 2012/0096742 A1 Apr. 26, 2012

Related U.S. Application Data

(63) Continuation of application No. PCT/KR2010/002014, filed on Apr. 1, 2010.

(30) Foreign Application Priority Data

Aug. 11, 2009 (KR) ..... 10-2009-0073951

(51) Int. Cl.

| | |
|---|---|
| ***A43B 23/00*** | (2006.01) |
| ***A43B 11/00*** | (2006.01) |
| ***A43B 21/00*** | (2006.01) |
| ***A43B 23/17*** | (2006.01) |

(52) U.S. Cl.
CPC ..... *A43B 23/17* (2013.01)

(58) Field of Classification Search
CPC ..... A43B 23/30; A43B 23/088; A43B 21/22; A43B 21/32; A43B 21/18; A43B 21/45; A43B 21/42; A43B 23/086; A43B 23/16–23/17; A43B 17/16; A43C 11/004; A43C 11/006; A43C 11/002
USPC ..... 36/45, 68, 7.1 A, 7.2, 6, 7.29
See application file for complete search history.

(56) References Cited

U.S. PATENT DOCUMENTS

| | | | | | |
|---|---|---|---|---|---|
| 297,469 | A | * | 4/1884 | Stickney | 36/1 |
| 553,130 | A | * | 1/1896 | Norris | 36/56 |
| 1,176,572 | A | * | 3/1916 | Lassig | 36/1 |
| 1,458,497 | A | * | 6/1923 | Perkins | 36/7.6 |
| 1,515,086 | A | * | 11/1924 | Baluta | 36/1 |
| 1,785,623 | A | * | 12/1930 | Gorjan | 36/8.1 |
| 1,824,832 | A | * | 9/1931 | Netherland | 36/70 R |
| 2,088,976 | A | * | 8/1937 | Resnik | 36/55 |
| 2,185,362 | A | * | 1/1940 | Troy | 36/45 |
| 2,245,235 | A | * | 6/1941 | Thurston | 36/46.5 |
| 2,274,085 | A | * | 2/1942 | Mitulski | 36/45 |
| 2,306,306 | A | * | 12/1942 | Ferrettie | 36/4 |

(Continued)

FOREIGN PATENT DOCUMENTS

| | | | | |
|---|---|---|---|---|
| JP | 05228006 | A | * | 9/1993 |
| JP | 06178703 | A | * | 6/1994 |

*Primary Examiner* — Khoa Huynh
*Assistant Examiner* — Timothy K Trieu
(74) *Attorney, Agent, or Firm* — Park & Associates IP Law, P.C.

(57) ABSTRACT

A heel counter support for a shoe can allow a wearer to conveniently wear the shoe, while also preventing the heel counter from being permanently bent. The heel counter support, which is embedded in the uppers of a heel counter of the shoe, includes: a support member that is formed in the same arc as the heel counter when viewed from the upper side thereof, is joined to a heel portion of a shoe sole, and is made of rigid or substantially hard synthetic resin; and an arc-shaped tension-maintaining portion that is joined to an upper end portion of the support member and is made of soft or substantially resilient synthetic resin. The tension-maintaining portion has an upper end that is resiliently flexed in a forward direction so that a wearer can easily insert the foot into the shoe.

4 Claims, 3 Drawing Sheets

(56) References Cited

U.S. PATENT DOCUMENTS

| | | | | | |
|---|---|---|---|---|---|
| 2,734,289 | A | * | 2/1956 | Heaton et al. | 36/68 |
| 3,007,262 | A | * | 11/1961 | Richards | 36/51 |
| 3,020,169 | A | * | 2/1962 | Phillips, Jr. et al. | 428/86 |
| 3,643,350 | A | * | 2/1972 | Paoletta et al. | 36/138 |
| 3,797,138 | A | * | 3/1974 | Closson, Jr. | 36/68 |
| 3,810,318 | A | * | 5/1974 | Epstein | 36/105 |
| 4,187,619 | A | * | 2/1980 | Gibbs | 36/10 |
| 4,255,876 | A | * | 3/1981 | Johnson | 36/83 |
| 4,308,673 | A | * | 1/1982 | Mobius | 36/68 |
| 4,354,319 | A | * | 10/1982 | Block et al. | 36/114 |
| 4,503,628 | A | * | 3/1985 | Mancinelli et al. | 36/58.6 |
| 4,508,582 | A | * | 4/1985 | Fink | 156/93 |
| 4,590,690 | A | * | 5/1986 | Pfander | 36/18 |
| 4,608,769 | A | * | 9/1986 | Sturlaugson | 36/68 |
| 4,625,435 | A | * | 12/1986 | Ueda | 36/68 |
| 4,638,576 | A | * | 1/1987 | Parracho et al. | 36/68 |
| 4,642,916 | A | * | 2/1987 | Collins | 36/58.6 |
| 4,793,077 | A | * | 12/1988 | Walkhoff et al. | 36/117.4 |
| 5,127,170 | A | * | 7/1992 | Messina | 36/105 |
| 5,189,814 | A | * | 3/1993 | Barma | 36/4 |
| 5,357,694 | A | * | 10/1994 | Mauck | 36/72 B |
| 5,367,795 | A | * | 11/1994 | Iverson et al. | 36/136 |
| 5,511,325 | A | * | 4/1996 | Hieblinger | 36/50.1 |
| 5,694,703 | A | * | 12/1997 | Diaz | 36/7.1 R |
| 5,765,296 | A | * | 6/1998 | Ludemann et al. | 36/51 |
| 6,115,940 | A | * | 9/2000 | Chen | 36/4 |
| 6,128,835 | A | * | 10/2000 | Ritter et al. | 36/45 |
| 6,151,802 | A | * | 11/2000 | Reynolds | 36/55 |
| 6,442,874 | B1 | * | 9/2002 | Long | 36/97 |
| 6,467,194 | B1 | * | 10/2002 | Johnson | 36/50.1 |
| 6,474,002 | B2 | * | 11/2002 | Chen | 36/55 |
| 6,584,707 | B1 | * | 7/2003 | Racine et al. | 36/97 |
| 6,662,474 | B2 | * | 12/2003 | Tomat | 36/69 |
| 6,871,424 | B2 | * | 3/2005 | Labonte et al. | 36/115 |
| 7,204,043 | B2 | * | 4/2007 | Kilgore | 36/68 |
| 7,337,560 | B2 | * | 3/2008 | Marvin et al. | 36/50.1 |
| 7,578,076 | B2 | * | 8/2009 | Pawlus et al. | 36/100 |
| 7,743,531 | B2 | * | 6/2010 | Aveni et al. | 36/105 |
| 7,908,774 | B2 | * | 3/2011 | Mirza et al. | 36/137 |
| 8,256,146 | B2 | * | 9/2012 | Loverin | 36/102 |
| 2002/0124436 | A1 | * | 9/2002 | Hatfield et al. | 36/45 |
| 2002/0139009 | A1 | * | 10/2002 | Mark | 36/54 |
| 2003/0145485 | A1 | * | 8/2003 | Chen | 36/3 A |
| 2004/0045192 | A1 | * | 3/2004 | Lin | 36/29 |
| 2004/0111921 | A1 | * | 6/2004 | Lenormand | 36/45 |
| 2008/0083138 | A1 | * | 4/2008 | Lacorazza et al. | 36/97 |
| 2008/0098620 | A1 | * | 5/2008 | Marvin et al. | 36/29 |

* cited by examiner

HEEL COUNTER SUPPORT FOR SHOE

REFERENCE TO RELATED APPLICATIONS

This is a continuation of pending International Patent Application PCT/KR2010/002014 filed Apr. 1, 2010, which designates the United States and claims priority of Korean Patent Application No. 10-2009-0073951 filed on Aug. 11, 2009, the entire contents of which are incorporated herein by reference.

FIELD OF THE INVENTION

The present invention relates to a heel counter support for a shoe, and more particularly, to a heel counter support for a shoe, which can allow a wearer to conveniently put on various kinds of shoes, such as low shoes and athletic shoes, without using any auxiliary means, such as a shoehorn, and which can prevent the heel counter from being bent.

BACKGROUND OF THE INVENTION

In general, a wearer grips the heel counter of the shoe with his or her fingers or uses a shoehorn or other tools to prevent the shoe from bending wearing the shoes, such as low shoes and athletic shoes. However, in the case of the shoehorn, there are inconveniences because the wearer has to always carry the shoehorn, and the wearer may lose it. shoehorn.

In the meantime, in the case that the wearer puts on the shoes without using the auxiliary means, such as the shoehorn, the heel counter of the shoe gets in contact with the heel of the wearer's foot or the heel counter part of the upper of the shoe is bent permanently or worn down, and hence, it causes a deterioration in appearance and a reduction of life. Accordingly, new means are needed for allowing the wearer to wear the shoes without the auxiliary means, such as the shoehorn, and for solving the bending problem in the heel counter of the upper.

In order to solve the above-mentioned problem, the inventor of the present invention has invented a heel counter support for a shoe and filed to the KIPO (Korean Patent Application No. 10-2009-0009431).

Korean Patent Application No. 10-2009-0009431 discloses a heel counter support for a shoe, which is embedded in the heel counter of the upper of the shoe. The heel counter support for the shoe according to the prior art is made of one selected from spring steel, shape-memory alloy, and synthetic resin, and includes: a holding portion that is formed in the same arc as the heel counter of the shoe and is positioned at the upper part of the heel counter of the shoe; tension-maintaining portions that are bent in such a way as to be forwardly sloped at both ends of the holding portion; and a support portion that is backwardly bent at the lower ends of the tension maintaining portions in such a way as to be positioned at the upper part of the outsole of the shoe.

Alternatively, the heel counter support for the shoe according to the prior art is made of one selected from spring steel, shape-memory alloy, and synthetic resin, and includes: a holding portion and is positioned at the upper part of the heel counter of the shoe; tension-maintaining portions that are formed in the same arc as the heel counter of the shoe as being viewed from the plane and are bent in such a way as to be downwardly sloped at both top dead centers located inside the upper end portion of the heel counter; and a support member embedded in the lower end portion of the heel counter in such a fashion that both lower end portions of the tension-maintaining portion are joined together.

SUMMARY OF THE INVENTION

Accordingly, the present invention has been made in an effort to solve the above-mentioned problems occurring in the prior arts, and it is an object of the present invention to provide a heel counter support for a shoe, which can allow a wearer to conveniently put on shoes without using any auxiliary means, such as a shoehorn, and which has a simple structure to prevent the heel counter from being bent.

To achieve the above objects, the present invention provides a heel counter support for a shoe including: a support member made of rigid synthetic resin and having a lower end joined to the shoe sole; and an arc-shaped tension-maintaining portion joined to an upper end portion of the support member and is made of soft synthetic resin to thereby naturally raise the heel counter up, so that a wearer does not feel irritation caused by foreign matters in a state where the wearer puts on the shoe and can put on the shoe without using auxiliary means, such as a shoehorn.

The heel counter support for the shoe according to the present invention can solve the problem of durability occurring when the heel counter of the shoe, such as a low shoe and an athletic shoe, is bent, and allow the wearer to conveniently put on the shoe without using separate auxiliary means, such as a shoehorn, because the heel counter is raised up by the heel counter support when the wearer puts on the shoe.

Particularly, when the heel counter support according to the present invention is applied to children's shoes, the parents' inconvenience of putting the shoes on a child can be also reduced.

DETAILED DESCRIPTION OF THE INVENTION

Reference will be now made in detail to the preferred embodiment of the present invention with reference to the attached drawings.

Figure 1:
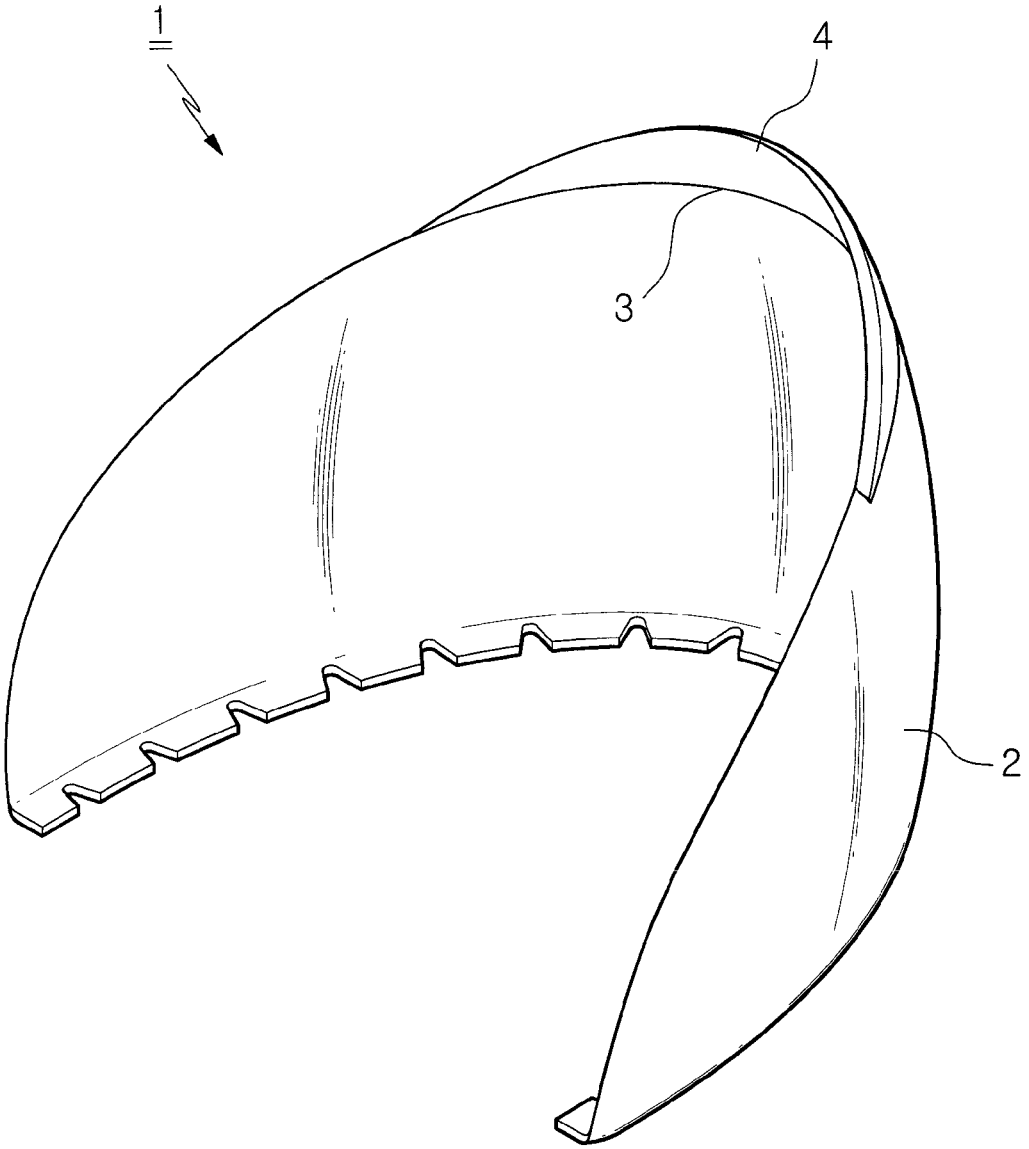
FIG. 1 is a perspective view of a heel counter support for a shoe according to a preferred embodiment of the present invention.
Figure 2:
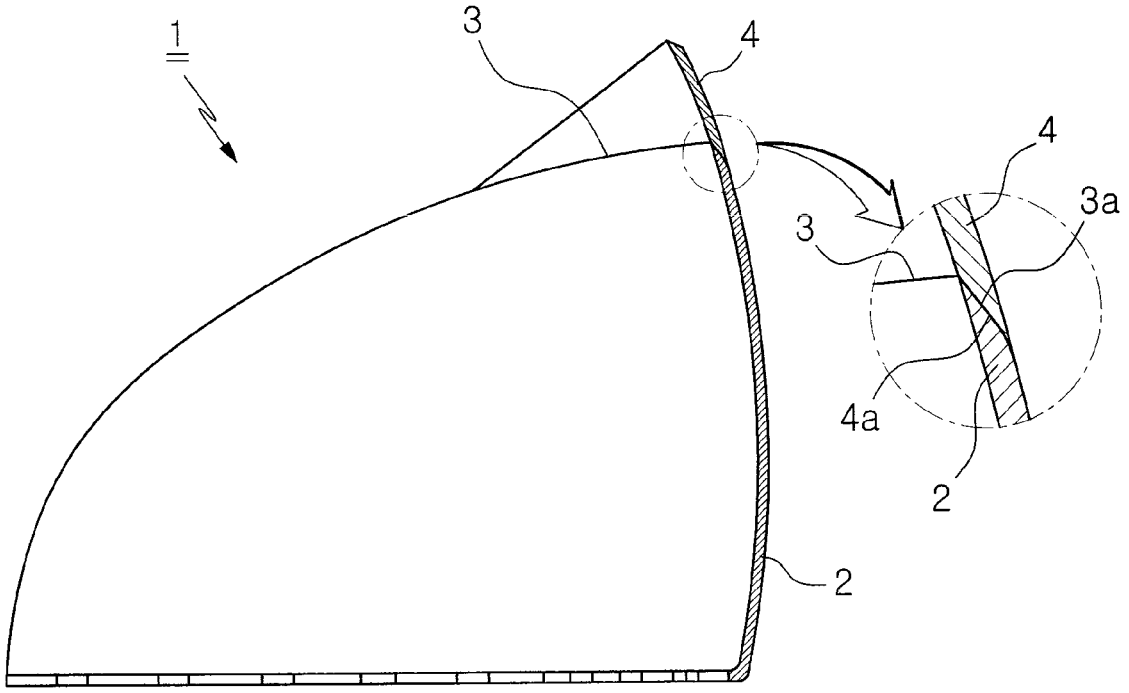
FIG. 2 is a side sectional view of the heel counter support for a shoe according to the present invention.
Figure 3:
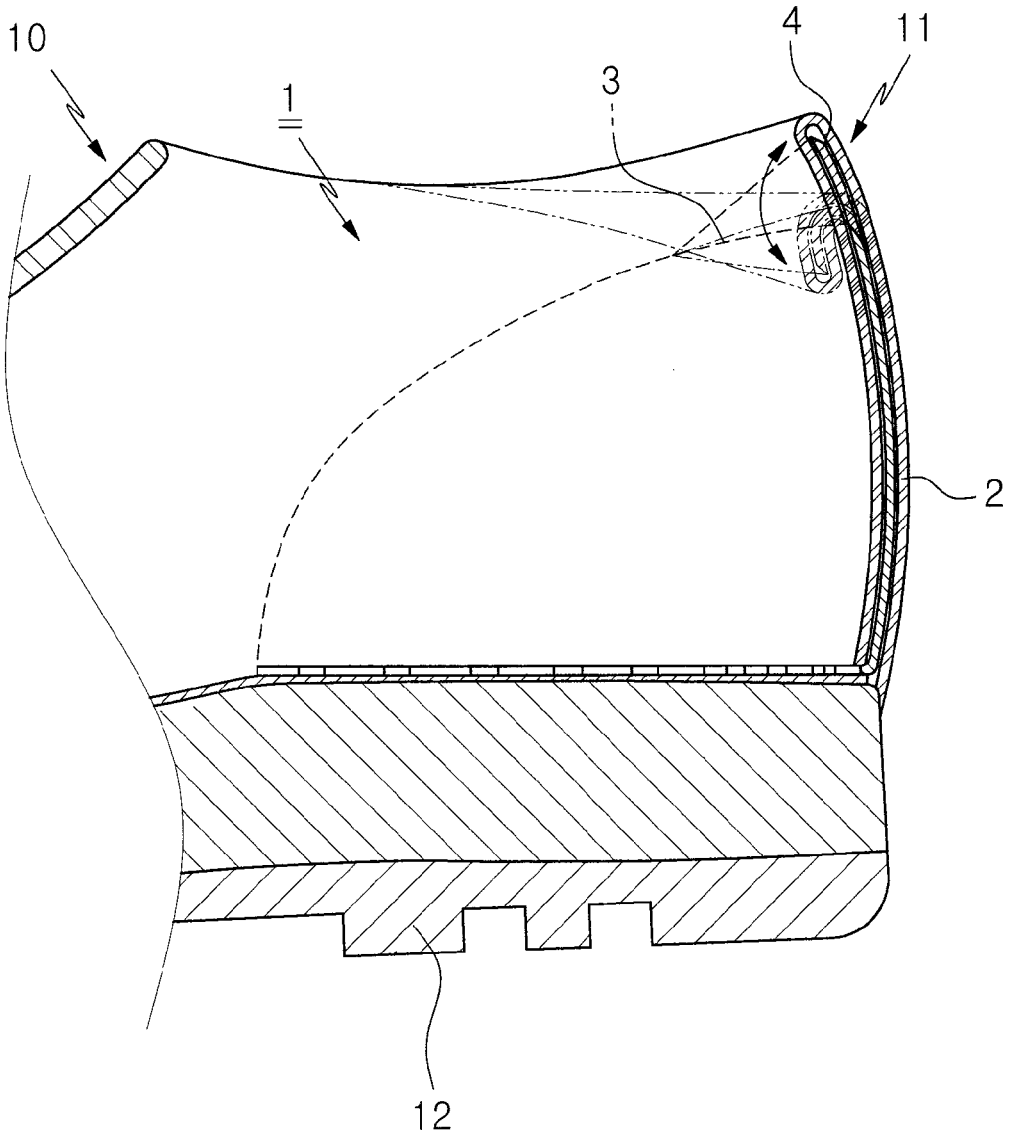
FIG. 3 is a side sectional view showing a used state of the present invention.

FIG. 1 is a perspective view of a heel counter support for a shoe according to a preferred embodiment of the present invention, FIG. 2 is a side sectional view of the heel counter support for a shoe according to the present invention, and FIG. 3 is a side sectional view showing a used state of the present invention.

The present invention provides a heel counter support 1 for a shoe that is embedded in the uppers of a heel counter 11 of a shoe 10 to thereby make a heel counter 11 be naturally bent and stretched when a wearer puts on the shoe 10.

That is, the heel counter support 1 for the shoe according to the present invention includes: a support member 2 that is formed in the same arc as the heel counter 11 as being viewed from the plane and has a lower end joined to the sole 12 of the shoe; and an arc-shaped tension-maintaining portion 4 that is joined to an upper end portion 3 of the support member 2 and has an elastic force for naturally bending and stretching the heel counter 11 of the shoe.

The support member 2 is made of rigid or hard synthetic resin, and the upper end portion 3 is formed generally horizontally. The tension-maintaining portion 4 is made of soft or resilient synthetic resin and is joined to the upper end portion 3 of the support member 2. It is preferable that the tension-maintaining portion 4 is made of resilient polyurethane, PVC, or others.

The tension-maintaining portion 4 is to naturally bend and stretch the heel counter 11 when the wearer puts on the shoe 10, and hence, the top of the tension-maintaining portion 4 to which the wearer's foot is inserted is bent a little forward.

The upper end portion 3 of the support member 2 and the tension-maintaining portion 4 have the same thickness and are bonded together by thermal bonding, double injection-molding, or bonding using adhesives.

The upper end portion 3 of the support member 2 has a slope joining portion 3*a* formed at the upper end thereof and the tension-maintaining portion 4 also has a slope joining portion 4*a* formed corresponding to the slope joining portion 3*a* of the upper end portion 3. Accordingly, the upper end portion 3 of the support member 2 and the tension-maintaining portion 4 are joined together in a state where the slope joining portions 3*a* and 4*a* abut each other, so that the joined portion between the two members becomes unitarily bonded.

Furthermore, as the joining face between the slope joining portions 3*a* and 4*a* has a slant section to increase the joined area between the upper end portion 3 and the tension-maintaining portion 4, it can provide a secure joining state.

As described above, the heel counter support 1 for the shoe according to the present invention can be applied to various kinds of shoes 10, such as low shoes, casual shoes, athletic shoes, and so on, and in the case that the heel counter support of the present invention is applied to the shoes, the wearer can easily put on the shoes without using any auxiliary means, such as a shoehorn.

In other words, when the wearer inserts the foot into the shoe 10 to which the heel counter support of the present invention is applied, as illustrated in FIG. 3, the tension-maintaining portion 4, which is made of synthetic resin and has an upper end portion bent forward, gets bent forward to thereby allow the wearer to put on the shoe, and then, when the wearer's foot is perfectly inserted into the shoe 10, the tension-maintaining portion 4 bent forward is stretched to its original shape by its elastic force.

The heel counter support for the shoe according to the present invention can solve the problem of durability occurring when the heel counter of the shoe, such as a low shoe and an athletic shoe, is bent, and allow the wearer to conveniently put on the shoe without using separate auxiliary means, such as a shoehorn, because the heel counter is raised up by the heel counter support when the wearer puts on the shoe. Particularly, when the heel counter support according to the present invention is applied to children's shoes, the parents' inconvenience of putting the shoes on a child can be also reduced.

What is claimed is:

1. A heel counter support for a shoe having an upper, a shoe sole and a heel counter, the heel counter support configured to support a heel of a wearer from a rear side of the heel, wherein the heel counter support is formed of two members of different materials, one being a support member and the other being a tension-maintaining member, wherein each of the support member and the tension-maintaining member are formed into a single layer, and the support member and the tension-maintaining member extend serially and are combined together into one integral part, wherein the support member is formed of hard synthetic resin materials, the support member having a main body portion with an arc shape in a same contour as the heel counter of the shoe, the main body portion having a predetermined length to support and cover the heel of the wearer, and a lower end portion extending laterally from a lower end of the main body portion and configured to be affixed to the shoe sole of the shoe at a heel side thereof, wherein the tension-maintaining member is arc-shaped and formed of elastic synthetic resin materials, the tension-maintaining member having a lower end portion abutting continuously against and unitarily joined to an upper end edge of the support member, an interim portion, and an upper end portion defining a terminal end of the tension-maintaining member, the interim portion and the upper end portion extending freely upwardly to a predetermined length from the upper end edge of the support member, wherein the heel counter support is separately formed from the upper, the sole, and the heel counter, and configured to be coupled to the heel counter of the shoe to support the heel of the wearer from the rear side of the heel, wherein the upper end portion of the tension-maintaining member is elastically bendable to flex in a forward direction to facilitate an introduction of a foot of the wearer into an inner space of the shoe while the support member formed of hard synthetic resin materials and coupled to the heel counter maintains original shape of the supporter member, and the upper end portion of the tension-maintaining member restores original shape of the upper end portion of the tension-maintaining member extending upwardly from the support member after the foot is received in the shoe as the tension-maintaining member is formed of elastic synthetic materials.

2. The heel counter support according to claim 1, wherein the lower end edge of the tension-maintaining member and the upper end edge of the support member each has a slantly-cut end face that are unitarily and smoothly continuously joined to each other.

3. The heel counter support according to claim 1, wherein the support member and the tension-maintaining member are enclosed between two opposing faces of the heel counter of the shoe.

4. The heel counter support according to claim 2, wherein the slantly-cut end faces of the lower end edge of the tension-maintaining member and the upper end edge of the support member, which are unitarily and smoothly continuously joined to each other, have a declining slope angle of contact seen from a cross section of the heel counter support.

* * * * *